United States Patent [19]

Focke

[11] 4,056,222

[45] Nov. 1, 1977

[54] COMPARTMENTALIZED STRUCTURE WITH PIVOTABLE SEPARATING WEBS

[75] Inventor: Heinz Focke, Verden, Germany

[73] Assignee: Focke & Pfuhl, Verden, Germany

[21] Appl. No.: 717,798

[22] Filed: Aug. 25, 1976

[30] Foreign Application Priority Data

Aug. 26, 1975 Germany ..... 2537811

[51] Int. Cl.[2] ..... B65D 3/24; B65D 5/48

[52] U.S. Cl. ..... 229/15; 229/42

[58] Field of Search ..... 229/15, 42, 28 BC

[56] References Cited

U.S. PATENT DOCUMENTS

| | | | |
|---|---|---|---|
| 3,258,189 | 6/1966 | Graser | 229/15 |
| 3,963,169 | 6/1976 | Gardner | 229/15 |
| 3,980,223 | 9/1976 | Curran | 229/15 |
| 3,982,684 | 9/1976 | David | 229/15 |
| 4,000,844 | 1/1977 | Weimer | 229/15 |

*Primary Examiner*—Davis T. Moorhead

*Attorney, Agent, or Firm*—Sughrue, Rothwell, Mion, Zinn and Macpeak

[57] ABSTRACT

There is provided a compartmentalized structure with separating webs formed by pivoting cut lugs from a flat blank, for insertion into a package for dividing objects such as bottles or jars. At least one lug is formed in the vertical region of a blank outside the separating region and extends into the separating region by multiple folding.

12 Claims, 4 Drawing Figures

COMPARTMENTALIZED STRUCTURE WITH PIVOTABLE SEPARATING WEBS

Figure 2:
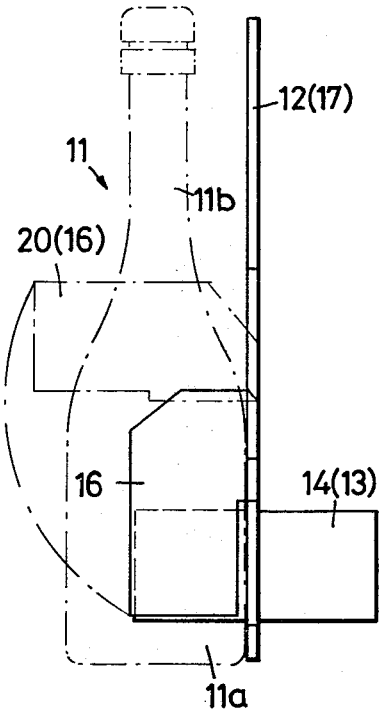

This invention relates to a compartmentalized structure with separating webs, more particularly transverse webs, formed by the pivoting of cut lugs from a flat blank, more particularly a longitudinal web, preferably for the insertion into a package for dividing objects such as bottles, jars and the like by means of longitudinal and transverse webs.

The invention primarily relates to separately produced loose compartmentalized structures which are inserted into packages for receiving objects such as bottles, jars and the like in regular groups, for example in double rows. The compartmentalized structure which forms longitudinal and transverse webs is provided to separate the individual objects from each other, more particularly to prevent impact between the bottles, jars and the like against each other.

It is an object of the present invention further to develop and improve a compartmentalized structure of the kind referred to hereinbefore in the sense that supporting webs, more particularly transverse webs, of adequate structural height and adequate dimensions can be produced transversely to the blank in a specific required region.

According to the present invention there is provided, in a compartmentalized structure with separating webs, more particularly transverse webs, formed by the pivoting of cut lugs from a flat blank, more particularly a longitudinal web, preferably for the insertion into a package for dividing objects such as bottles, jars and the like by means of longitudinal and transverse webs, the improvement which comprises at least one lug being formed in the vertical region of a blank outside the separating region and extends into the separating region by multiple folding.

With the invention, it is possible to form separating webs, more particularly transverse webs, which are formed from the flat blank by cutting or the like in a region which is distal with respect to the actual separating region, said separating webs being brought into a relative position by means of folding so that the separating web thus formed extends in the separating region.

According to a preferred embodiment of the invention, a compartmentalized structure for dividing six objects, more particularly bottles, arranged in a double row, is formed from a blank in whose bottle region two lug are cut and a third additional lug is also cut thereabove. One of the bottom lugs is connected to the blank by means of an approximately central residual join. Pivoting about a vertical axis in the region of the said residual join causes a double web that extends to both sides of the longitudinal middle web to be formed as a transverse web. A further lug based on the available surface area in the bottom part of the blank is constructed as a transverse web which merely extends to one side. A lug, set by multiple folding, more particularly double folding, so that the second transverse web is formed opposite the transverse web which extends merely in the region of one side of the longitudinal middle web, is marked above the aforementioned transverse web.

A further preferred feature of the invention is the special construction and cutting of the lug for the separating web which is formed by multiple folding.

Figure 3:
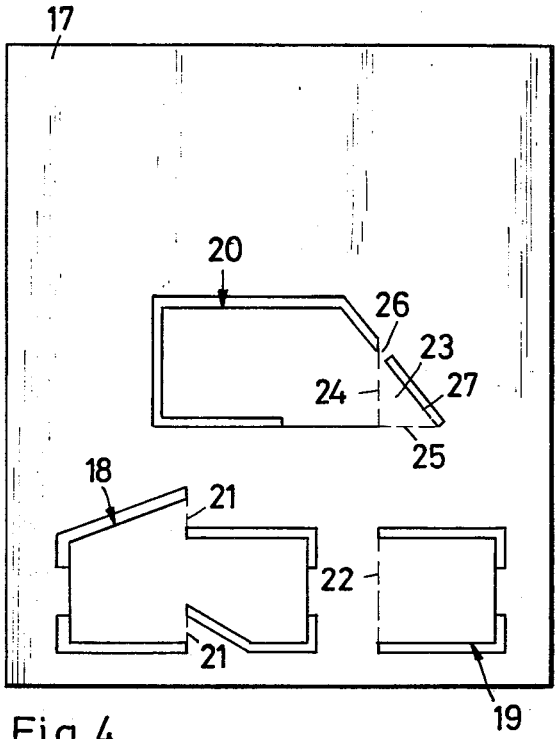
Figure 4:
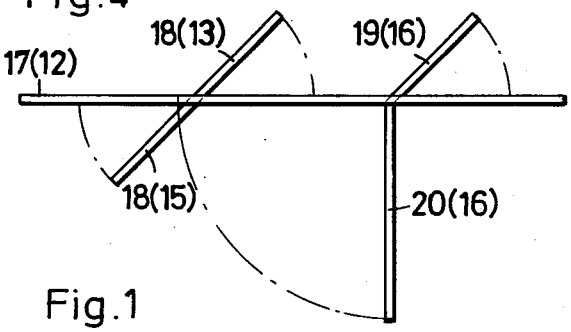
Figure 1:
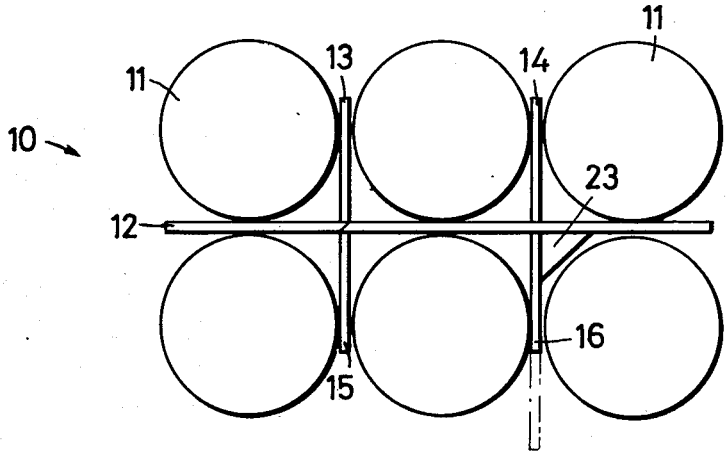

For a better understanding of the present invention and to show how the same may be carried into effect, reference will now be made, by way of example, to the accompanying drawings, in which:

FIG. 1 shows a plan view of a completely assembled compartmentalized structure according to the invention, with objects, namely bottles, FIG. 2 shows a view, in the longitudinal direction of FIG. 1, of the compartmentalized structure, FIG. 3 shows a blank which forms the starting configuration for producing the compartmentalized structure of FIGS. 1 and 2, and FIG. 4 shows a plan view of the blank of FIG. 3, illustrating an intermediate position of the lugs for forming transverse webs.

Referring now to the drawings, the illustrated embodiment relates to a separate compartmentalized structure 10 which can be separately produced and can be inserted as an individual component into a package or the like. The present embodiment more particularly relates to an arrangement of six objects, namely bottles 11, in a double row. As can be seen by reference to FIG. 1, the bottles 11 are separated from each other by a longitudinal middle web 12 and transverse webs 13, 14, 15 and 16.

The transverse webs 13 to 16 are arranged at a height so that they extend in the region of the larger diameter of the objects or bottles 11. The transverse webs 13 to 16, or at least a substantial section thereof, are situated in the region of a lower part **11*a* in the case of conventional wide-bodied champagne bottles with a short, squat, lower cylindrical part 11*a* and a neck 11*b* which is long relative to the former. The said region of the bottom part 11*a* is, therefore, the actual separating range for separating the bottles 11 from each other. The length of the transverse webs 13 to 16 is also arranged so that they extend beyond the transversely orientated vertical longitudinal middle plane of the bottles 11. The transverse webs 13 to 16, therefore, extend in every case into the region in which the bottles 11** are situated at the smallest external distance from each other.

A compartmentalized structure of the said kind is formed from a blank 17 shown in FIG. 3. The blank 17 is provided with lugs 18, 19, and 20 which are formed by cutting or the like. The lug 18 is constructed in known manner and is connected to the remaining part of the blank in the region of a residual join which is formed in the region of a vertical pivoting axis 21. The lug 18 is free outside the said pivoting axis 21 or outside of the two axial portions which are shown in FIG. 3. As shown in FIG. 4, it can, therefore, be moved by folding about the pivoting axis 21 from the position in the plane of the blank 17 into the position according to FIG. 4 and beyond the said position into that shown in FIG. 1. Two transverse webs 13 and 15 are, therefore, produced fron one blank 18.

Because of the required longitudinal extent of the lug 18, the area in this region of the blank 17 is confined to that which allows the lug 19 merely to form a transverse web 14 (extending on one side of the blank 17 or of the longitudinal web 12). The lug 19 can be folded about a vertical pivoting axis 22 which is formed in the region of a residual join with the remaining part of the blank 17. The residual joint in this case also extends over the entire length of the pivoting axis 22.

As a special feature the lug 20 is constructed to form the transverse web 16. The lug 20 is situated outside the region of the lugs 18 and 19 and, therefore, to a greater or lesser extent outside the separating region formed in this case by the part 11*a* of the bottles 11. The lug 20 is joined to the blank 17 through a residual joint which is approximately formed as a triangular gusset 23. Relative to the actual lug 20, the triangular gusset 23 forms a vertical pivoting axis 24 and relative to the blank 17 it forms a horizontal pivoting axis 25.

To form the transverse web 16, the lug 20 is first folded about the pivoting axis 24 into an intermediate position shown in dash dot lines in FIGS. 1 and 2, approximately perpendicularly to the blank 17. In a further folding step, the lug 20 is then folded downwardly about the horizontal pivoting axis 25 into the final position in which it functions as the transverse web 16. To this end, the triangular gusset 23 extends in a plane perpendicular to the blank 17. It forms the connecting element between the downwardly suspended transverse web 16 and the blank 17 which is then inserted as the longitudinal web 12.

An auxiliary joint 26 is provided between the lug 20 and the blank 17 to adjoin the pivoting axis 24 so as to ensure that the previously described sequence of folding the lug 20 first about the pivoting axis 24 and then about the pivoting axis 25 is maintained. The said auxiliary joint permits proper folding about the pivoting axis 24. The auxiliary joint 26 is separated in the course of folding about the pivoting axis 25.

As can be seen from the drawings, the lug 20 can be constructed to a length in which it extends over an adequate portion of the separating region. The residual joint in the form of the triangular gusset 23 is so selected that it does not affect the directly adjacent bottle. The cutting edge 27 of the triangular gusset which is situated at a distance from the pivoting axes 24 and 25 can however be formed in arcuate form or in some other form which curves towards the pivoting axes 24 and 25 so that the said residual join occupies less space in the position according to FIG. 1.

The cuts for forming the lugs 18, 19 and 20 in most regions are made to form a distinct gap. This facilitates pivoting of the lugs 18, 19 and 20, Separation is confined to the actual cut in only some portions. The cutting or blanking surfaces are therefore situated directly adjacently and thus locate the lugs in the plane of the blank 17 prior to the pivoting motion.

What is claimed is:

1. In a compartmentalized structure for insertion in packages for separating articles such as bottles or the like, by means of longitudinal and cross webs, said structure comprising a flat blank serving as the longitudinal web, said flat blank being provided with precut lugs adapted to be pivoted to form cross webs, the improvement comprising:

at least one lug being formed in the blank outside of the separating region determined by the cross webs and being extended into the separating region at right angles to the longitudinal web by folding it about at least two fold lines.

2. The compartmentalized structure of claim 1, wherein said bottles comprise objects with regions of different diameters and wherein said at least one lug is cut outside the region of largest diameter and extends into said region in the form of a separating web and a transverse web by virtue of multiple folding.

3. The compartmentalized structure of claim 1, in which the separating web, formed by multiple folding, extends as a transverse web on only one side of the blank and is complemented on the other side by a transverse web situated in the same plane, formed by pivoting of a second lug about a vertical pivoting axis.

4. The compartmentalized structure of claim 1 in which the separating web formed by multiple folding is connected to the blank by means of a residual joint in a region situated outside the separating region.

5. The compartmentalized structure of claim 4, wherein the residual joint is oriented in a plane which is approximately perpendicular to the plane of the blank between said at least one lug, which is folded into the separating web, and the blank.

6. The compartmentalized structure of claim 4, in which the residual joint is constructed approximately as a triangular gusset, the short members of which form pivoting axes.

7. The compartmentalized structure of claim 1, wherein the at least two fold lines are such that said at least one lug is foldable about two pivoting axes from an initial position in the plane of the blank into the position in which it functions as the separating web.

8. The compartmentalized structure of claim 7, wherein said at least two fold lines are such that said at least one lug is foldable from an initial position, first about a vertical pivoting axis and then about a horizontal pivoting axis, in each case through approximately 90°.

9. The compartmentalized structure of claim 1, wherein said at least one lug is precut and said at least two fold lines and said at least one lug are located on the blank in an intermediate position, by means of a detachable auxiliary joint such that the lug can first be folded about the vertical pivoting axis and then, after removal of the auxiliary joint, about the horizontal pivoting axis.

10. The compartmentalized structure of claim 9 in which the auxiliary joint is formed as an extension of the (first) vertical pivoting axis.

11. The compartmentalized structure of claim 1, for separating six bottles arranged in a double row and wherein said blank is provided in its bottom with two lugs of which at least one is foldable about an approximately central upright pivoting axis to form a double transverse web and the other is foldable about a lateral upright pivoting axis to form a transverse web extending on one side of the plane of the blank, and wherein said at least one lug formed outside of the separating region completes the transverse web.

12. The compartmentalized structure of claim 7 in which the (first) vertical pivoting axis of the lug is arranged coaxially with respect to the pivoting axis of the second lug.

* * * * *